United States Patent [19]

Miller

[11] Patent Number: 4,924,973

[45] Date of Patent: May 15, 1990

[54] ELEVATOR PAD HANGING SYSTEM

[76] Inventor: Sydney L. Miller, 33 Lyman Rd., Chestnut Hill, Mass. 02167

[21] Appl. No.: 217,394

[22] Filed: Jul. 11, 1988

[51] Int. Cl.[5] ..... B66B 9/00

[52] U.S. Cl. ..... 187/1 R; 248/552; 160/368.1; 70/58

[58] Field of Search ..... 187/1 R; 248/552, 551, 248/201, 316.8; 160/368.1, 354; 70/60, 57, 58

[56] References Cited

U.S. PATENT DOCUMENTS 4,003,228 1/1977 Lieuens et al. ..... 70/58
4,076,158 2/1978 Barr ..... 248/552

FOREIGN PATENT DOCUMENTS 6538 of 1913 United Kingdom ..... 248/552

*Primary Examiner*—H. Grant Skaggs

*Assistant Examiner*—Kenneth Noland

*Attorney, Agent, or Firm*—Hale and Dorr

[57] ABSTRACT

Disclosed is an improved elevator pad hanging system that includes a first groove on which a loop in the elevator pad will rest. In one embodiment, a second groove, which is separated from the first groove by a flange, is provided and has a diameter which is just slightly less than the dimensions of the opening of a padlock as those dimensions are defined by its shackle. Another flange is located on the opposite side of the groove so that the padlock, when placed around the groove and locked, is securely trapped in the groove. As a result, the lock cannot be removed without the key, and the elevator pad cannot be removed over the lock. In an alternate embodiment, a second flange includes a hole therethrough having a diameter slightly greater than the diameter of the shackle of the padlock which is locked through the flange.

5 Claims, 2 Drawing Sheets

ELEVATOR PAD HANGING SYSTEM

BACKGROUND OF THE INVENTION

The present invention relates to a system for hanging elevator pads against a wall of an elevator cab and more particularly to an elevator pad hanging system which will prevent the unauthorized removal of an elevator pad from an elevator cab wall.

As shown in FIG. 1, elevator pads 10 are traditionally used to cover walls of an elevator cab 12 in order to prevent scratching of the walls when large or heavy objects are moved into the cab. These pads are generally held by a row of hooks which are screwed into the elevator wall. One type of hook 14, which is shown in FIGS. 2 and 3, includes a single groove into which a loop in the elevator pad is hooked. A problem with the use of the hooks 14 are that the elevator pads 10 are bulky and are likely to come loose and fall off the hooks. In addition, these pads 10 are generally used in public elevators, and on occasion such pads are stolen.

It is therefore a principal object of the present invention to provide an elevator pad hanging system which will securely hang elevator pads against the walls of an elevator cab.

Another object of the present invention is to provide an elevator pad hanging system that will prevent the theft of the elevator pads.

It is a further object of the present invention to provide an elevator pad hanging system that is inexpensive to manufacture and which securely holds elevator pads having loops of standard sizes.

SUMMARY OF THE INVENTION

Accordingly, the improved elevator hanging system of the present invention includes a first groove onto which a loop in the elevator pad will rest. In one embodiment, a second groove, which is separated from the first groove by a flange, is provided and has a diameter which is just slightly smaller than the dimensions of the opening of a padlock defined by its shackle. Another flange is located on the opposite side of the groove so that when the padlock is placed around the groove and locked, it is securely trapped in the groove. As a result, since the lock cannot be removed without a key, the elevator pad cannot be removed either because the loop does not fit over the lock. In an alternate embodiment, a second flange includes a hole therethrough having a diameter slightly greater than the diameter of the shackle of the padlock which is locked through the flange.

These and other objects and features of the present invention will be more fully understood from the following detailed description which should be read in light of the accompanying drawings in which corresponding reference numerals refer to corresponding parts throughout the several views.

DETAILED DESCRIPTION OF THE DRAWINGS

Figure 1:
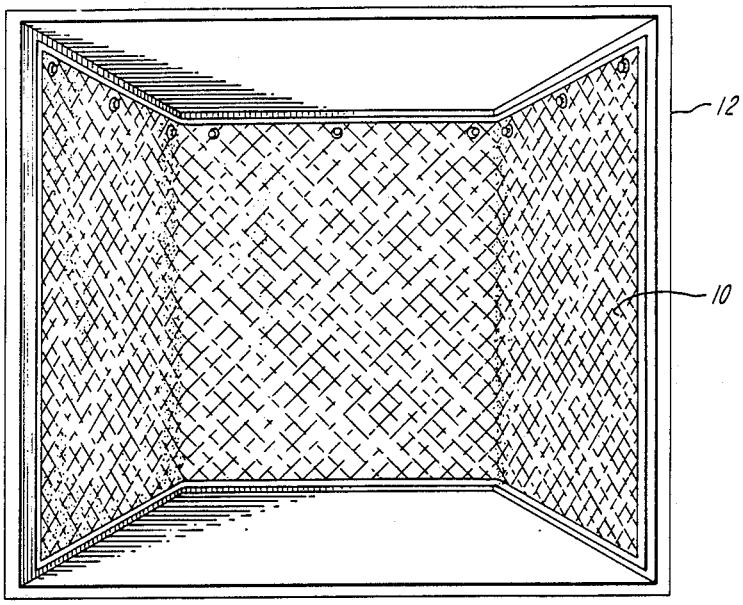
FIG. 1 (PRIOR ART)
FIG. 1 is a view of an elevator cab on which elevator pads have been hung to protect the walls.
Figure 2:
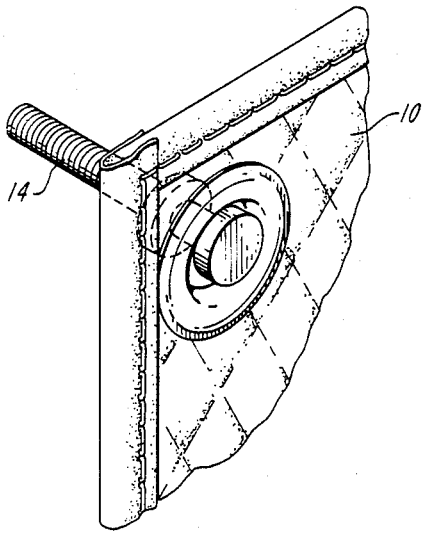
FIG. 2 (PRIOR ART)
FIG. 2 is a perspective view of a prior art elevator pad hook on which an elevator pad has been hung.
Figure 3:
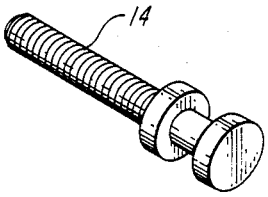
FIG. 3 (PRIOR ART)
FIG. 3 is a perspective view of a prior art elevator pad hook shown in FIG. 2.
Figure 4:
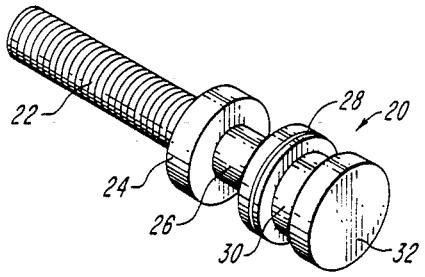
FIG. 4 is a perspective view of one embodiment of the hook for the elevator pad hanging system of the present invention.
Figure 6:
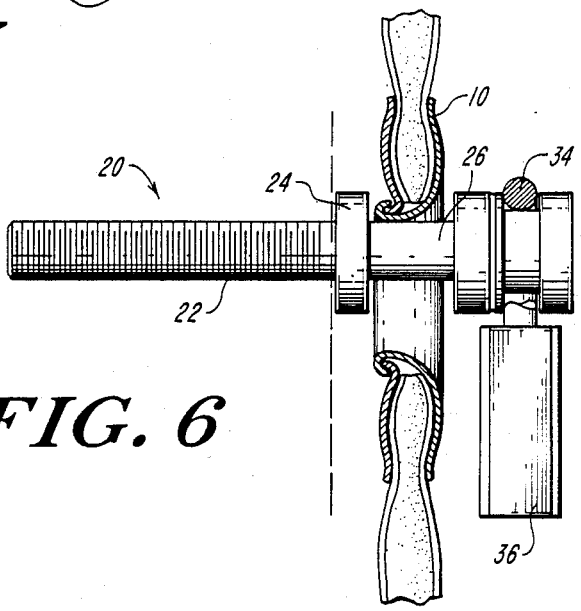
FIG. 6 is a side elevational view, partly in section, of the elevator pad hanging system including the hook shown in FIG. 4.

Referring to FIGS. 4 and 6, one embodiment of the elevator pad hanging system of the present invention includes a hook 20 with a screw section 22 which is connected to a first flange 24 which in turn is connected to a groove portion 26. On the opposite side of the groove portion 26 is a second flange 28 which is generally of a diameter similar to that of the first flange portion 24. Connected to the opposite side of the second flange 28 is a second groove portion 30 having a diameter less than the diameter of surrounding flange 28, 32. The diameter of this second groove 30 is chosen so that it is just slightly smaller than the distance between opposite sides of the shackle 34, so that the shackle 34 of the lock may fit over this groove and not be able to move out of the groove 30 because of the two flanges 28, 32 surrounding groove 30.

In use, the threaded section 22 is inserted into a receiving female member (not shown) embedded in the wall of the elevator cab. After the pads are placed over groove 26, a padlock is placed around the second groove 30 thereby securely locking and fastening the elevator pad against the wall.

Figure 5:
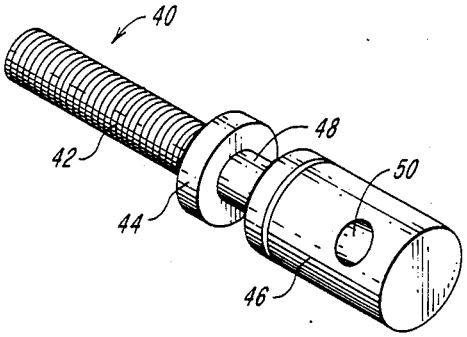
FIG. 5 is a perspective view of an alternate embodiment of the hook for the elevator pad hanging system of the present invention.
Figure 7:
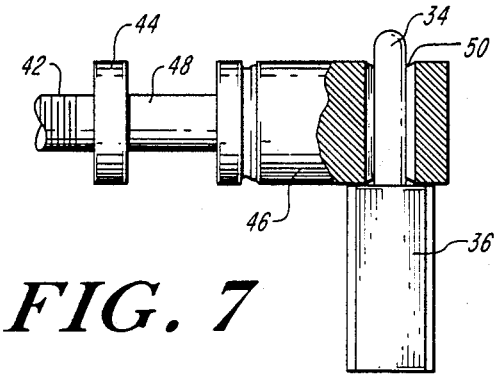
FIG. 7 is a side elevational view, partly in section, of the elevator pad hanging system including the hook, shown in FIG. 5.

Referring now to FIGS. 5 and 7, an alternate embodiment of the present invention is shown which includes a threaded portion and two flange portions 44, 46. A groove section 48 is located between the flanges to receive the elevator pad loop. Flange 46 includes an opening 50 through its body. Opening 50 has a diameter just slightly larger than the diameter of the shackle 34.

In use, after the hook 40 is threaded into the wall of the elevator, the elevator pad is placed over the flange 46 until it lies in groove 48. Then, the shackle 34 of padlock 36 is placed through the hole and locked, thereby securing the elevator pad against the wall of the elevator cab.

While the foregoing invention has been described with reference to its preferred embodiments, various alterations and modifications will occur to those skilled in the art. All such variations and modifications are intended to fall within the scope of the appended claims.

What is claimed is:

1. A system for securely holding elevator pads against a wall of an elevator, said system comprising:

means for fastening said system to the wall;

a first groove in which the elevator pad rests when it is held by said system;

a first flange located between said means for fastening said system and said first groove;

a second groove surrounded by a second flange and a third flange, said second flange located between said first groove and said second groove, said third flange located on the side of said second groove opposite said second flange;

locking means attachable around said second groove for preventing the elevator pad from passing over said third flange.

2. The system for securely holding elevator pads of claim 1 wherein said locking means comprises a padlock having a shackle with dimensions great enough to enable said padlock to fit around said second groove when said shackle is in a locked position and small enough so that said padlock cannot escape said second groove over said second or third flange when said shackle is in locked position.

3. The system for securely holding elevator pads of claim 1 wherein said means for fastening said system to said wall comprises;

an insert having internal threads, said insert being embedded in a wall of an elevator cab;

means attached to said first flange and having external threads for engaging said internal threads.

4. A system for securely holding elevator pads against a wall of an elevator cab comprising:

means for fastening said system to the wall, said means for fastening including an extended member;

a first groove between a first flange and a second flange on said extended member, said second flange having a diameter smaller than the diameter of a loop in the elevator pad;

a second groove located between said second flange and a third flange;

locking means positionable around said second groove for preventing the elevator pad resting in said first groove from passing over said third flange.

5. The system for securely holding elevator pads against the wall of an elevator cab of claim 4 wherein said locking means comprises a padlock having a shackle with dimensions great enough to enable said padlock to fit around said second groove when said shackle is in a locked position and small enough so that said padlock cannot escape said second groove over said second or third flange when said shackle is in a locked position.

* * * * *